US011291604B2

(12) United States Patent
Urbanek et al.

(10) Patent No.: US 11,291,604 B2
(45) Date of Patent: Apr. 5, 2022

(54) WARNING DOME ENHANCING TOOL AND METHOD

(71) Applicants: James Urbanek, Boca Raton, FL (US); Rodney Brown, Boca Raton, FL (US); Matthew Urbanek, Boca Raton, FL (US); Tyler James Whiting, Gainesville, TX (US)

(72) Inventors: James Urbanek, Boca Raton, FL (US); Rodney Brown, Boca Raton, FL (US); Matthew Urbanek, Boca Raton, FL (US); Tyler James Whiting, Gainesville, TX (US)

( * ) Notice: Subject to any disclaimer, the term of this patent is extended or adjusted under 35 U.S.C. 154(b) by 0 days.

(21) Appl. No.: 16/728,126

(22) Filed: Dec. 27, 2019

(65) Prior Publication Data

US 2021/0000681 A1 Jan. 7, 2021

Related U.S. Application Data

(63) Continuation-in-part of application No. 16/502,182, filed on Jul. 3, 2019.

(51) Int. Cl.
*E01C 15/00* (2006.01)
*A61H 3/06* (2006.01)

(52) U.S. Cl.
CPC ..... *A61H 3/066* (2013.01); *E01C 15/00* (2013.01)

(58) Field of Classification Search
CPC ..... A61H 3/066; E01C 15/00
USPC ..... 404/9, 12–16, 72, 75; 427/136, 272, 282
See application file for complete search history.

(56) References Cited

U.S. PATENT DOCUMENTS

| | | | | |
|---|---|---|---|---|
| 5,271,690 | A * | 12/1993 | Fennessy, Sr. | A61H 3/066 404/9 |
| 5,320,790 | A * | 6/1994 | Lowe | A61H 3/066 249/127 |
| 5,385,770 | A * | 1/1995 | Julnes | E01F 13/022 427/137 |
| 5,827,009 | A * | 10/1998 | Kokoletsos | E01C 19/16 404/75 |
| 6,499,910 | B1 * | 12/2002 | Grahmbeek | E01C 23/163 404/75 |
| 9,311,831 | B2 * | 4/2016 | Henshue | A61H 3/066 |
| 10,184,216 | B2 | 1/2019 | Urbanek et al. | |
| 2005/0013662 | A1 * | 1/2005 | Provenzano, III | A61H 3/066 404/75 |
| 2008/0090008 | A1 * | 4/2008 | Julnes | A61H 3/066 427/256 |
| 2009/0169297 | A1 * | 7/2009 | Koehn | E01C 5/20 404/9 |
| 2013/0212046 | A1 * | 8/2013 | Henshue | E01C 11/222 705/500 |
| 2014/0023435 | A1 | 1/2014 | Urbanek et al. | |

* cited by examiner

*Primary Examiner* — Raymond W Addie
(74) *Attorney, Agent, or Firm* — Sughrue Mion, PLLC

(57) ABSTRACT

Detectable warning areas (DWAs) and methods of forming the same. A dome-forming material can be mixed with a catalyst to form a mixture, which can then be poured into a dome-shaped cavity of a die-cast mold or a reusable mat template with a grommet. A peg may be inserted into the mixture. The mixture may be allowed catalyze and harden.

4 Claims, 20 Drawing Sheets

WARNING DOME ENHANCING TOOL AND METHOD

CROSS-REFERENCE TO RELATED APPLICATIONS

This is a continuation-in-part of U.S. application Ser. No. 16/502,182 filed Jul. 3, 2019, the disclosure of which is incorporated by reference in its entirety. The entire content of U.S. Pat. No. 10,184,216, issued Jan. 22, 2019, is also incorporated herein by reference in its entirety.

BACKGROUND OF THE INVENTION

Detectable warning areas (DWAs) are integral surface features built in or applied to walking surfaces or other elements to warn individuals with impairments, such as visual impairments, of hazards on a circulation path. DWAs are often standardized and typically include raised features, such as domes. These domes may be truncated. DWAs are generally found along a sidewalk, near a curb, before a road or door at an airport, bus station, or train station, or along other circulation paths.

Truncated domes are have been chosen as a uniform standard for use in DWAs by the United States federal government (as well as many other international and local governments) over others as an approved surface texture allowed under specified criteria such that continuity of design for the visually impaired is maintained. According to the Americans with Disabilities Act Accessibility Guidelines (ADAAG), truncated domes are to be placed around hazardous vehicular ways, access ramps, transit platform edges, and/or where predetermined edge protection is required.

One existing method to form DWAs includes using an epoxy-based dome-forming material in a relatively rigid, re-usable template made of hard rubber. The dome-forming material may be applied to the template, for example, using a squeeze bottle, and then the template may be removed almost immediately and the dome-forming material may be allowed to cure after the template is removed. While curing, the dome-forming material can rise, such that it no longer takes the same shape as the template.

Another existing method to form DWAs is described in U.S. Pat. No. 10,184,216 (U.S. '216), issued Jan. 22, 2019, which is incorporated in its entirety by reference. In U.S. '216, a method is disclosed wherein a mat template comprising a plurality of openings is placed over a substrate. The mat template may be filled with an epoxy-based or acrylic-based dome material, and applied to the mat template using a squeegee. Then dome material may be allowed to cure for a longer period of time than the previously discussed method, then may be removed from the mat template. Under this approach, while the dome may retain its shape better than the previously discussed method, it may be difficult to produce domes at a location different from the location where the domes are to be applied to a substrate.

SUMMARY OF THE INVENTION

This disclosure relates to DWAs and methods of forming the same. A DWA discussed herein can include one or more domes. Any or all of the domes of the DWA can be a truncated dome.

A method of forming a DWA having one or a plurality of domes can include: mixing a dome-forming material with a catalyst to form a mixture, pouring the mixture into a dome-shaped cavity of a die-cast mold, inserting into the dome-shaped cavity of the die-cast mold a peg, allowing the mixture in the dome-shaped cavity of the die-cast mold to catalyze and harden, and removing from the dome-shaped cavity of the die-cast mold a molded dome.

In this method, when pouring the mixture into the dome-shaped cavity of the die-cast mold, the pouring may include pouring the mixture to the top of the dome-shaped cavity of the die-cast mold.

In the method, the peg may comprise a shaft and two wings.

In the method the peg may comprise a screw.

In the method, the dome-shaped cavity may have a bottom portion corresponding to an upper portion of the molded dome and a top portion corresponding to a lower portion of the molded dome, such that the bottom portion of the dome-shaped cavity may have a diameter which is within a range of 50 to 65 percent of a diameter of the upper portion of the dome-shaped cavity, wherein the diameter of the upper portion of the dome-shaped cavity may be within a range of 0.9 inches to 1.4 inches, and wherein the dome-shaped cavity may have a depth in a range of 0.18 inches to 0.22 inches.

A method of forming a detectable warning area (DWA) comprising at least one dome may comprise: preparing the at least one dome, the at least one dome comprising a peg, drilling a hole in a substrate, applying a bonding agent to the substrate and the hole in the substrate, and inserting into the hole the peg of at least one dome.

In the method, the preparing the at least one dome may comprises: mixing a dome-forming material with a catalyst to form a mixture, pouring the mixture into a dome-shaped cavity of a die-cast mold, inserting into the dome-shaped cavity of the die-cast mold a peg, allowing the mixture in the dome-shaped cavity of the die-cast mold to catalyze and harden, and removing from the dome-shaped cavity of the die-cast mold the at least one dome.

The method may comprise cleaning the hole in the substrate after drilling the hole.

The method may comprise vacuuming the hole in the substrate after drilling the hole.

The method may comprise grinding the outer top surface of the at least one dome with a drilling attachment.

In the method, the preparing the at least one dome may further comprise when pouring the mixture into the dome-shaped cavity of the die-cast mold, pouring the mixture to the top of the dome-shaped cavity of the die-cast mold.

The method may be such that the dome is of a truncated shape.

The method may be such that the peg comprises a shaft and two wings.

The method may be such that the peg comprises a screw.

The method may be such that the dome-shaped cavity may have a bottom portion corresponding to an upper portion of the at least one dome and a top portion corresponding to a lower portion of the at least one dome, wherein the bottom portion of the dome-shaped cavity may have a diameter which is within a range of 50 to 65 percent of a diameter of the upper portion of the dome-shaped cavity, wherein the diameter of the upper portion of the dome-shaped cavity may be within a range of 0.9 inches to 1.4 inches, and wherein the dome-shaped cavity may have a depth in a range of 0.18 inches to 0.22 inches.

The method may comprise: preparing a plurality of domes, each of the plurality of domes comprising a peg, drilling a plurality of holes into the substrate, applying the bonding agent to the plurality of holes, and inserting into the plurality of holes the pegs of the plurality of domes, wherein, after the pegs of the plurality of the domes are inserted into the holes, ensuring that all of the domes have a center-to-center spacing in the range of 1.6 inches to 2.4 inches and a base-to-base spacing of at least 0.65 inches.

A drilling apparatus for grinding a portion of a detectable warning area (DWA) may comprise a shaft, and a drilling portion including at least one blade, wherein the at least one blade may be configured so as to grind the outer surface of a dome of a detectable warning area (DWA) to a truncated shape.

A method of grinding a portion of a detectable warning area (DWA) may comprise: using a drilling attachment comprising a shaft and a drilling portion including at least one blade to grind the outer surface of a dome of a detectable warning area (DWA) to a truncated shape.

The afore-mentioned drilling apparatus may be such that the shaft comprises a U-shaped portion on one distal end thereof, and wherein the drilling attachment is configured to fit into and be secured within the U-shaped portion.

A method of forming a detectable warning area comprising at least one dome may comprise: forming a substrate, inserting into an opening of a mat template, a dome-forming insert, the dome forming insert having a geometrical shape corresponding to the dome of the detectable warning area, and an upper hole and a lower hole, placing the mat template having the insert placed into the opening thereof on the substrate, mixing a dome-forming material with a catalyst, filling the mat template with the doming-forming material mixed with the catalyst by pouring the dome-forming material over the mat template and working the dome-forming material into the upper hole of the insert placed into the opening of the mat template, allowing the dome-forming material mixed with the catalyst to cure, and removing from the substrate the mat template and the insert, thereby leaving the dome of the detectable warning area formed on the substrate.

This method may further comprise applying pressure to the underside of the insert with a tool to release the insert from the substrate and/or mat template.

A method of forming a detectable warning area, may comprise: placing a grommet into a corresponding hole in the bottom of a mat template; placing the mat template on top of a substrate where the detectable warning area is to be formed; securing the mat template to the substrate; pouring dome-forming material into an opening in the hole in the top of the mat template such that the dome-forming material fills an inner area inside of the grommet; allowing the dome-forming material to cure; and removing from the substrate, the mat template, thereby leaving a detectable warning area formed on the substrate.

In this method, the grommet may have a top opening diameter of 0.9 inches to 1.4 inches, inclusive, a bottom opening diameter of 50-65% of the top opening diameter, inclusive, and a height of 0.18 inches to 0.22 inches, inclusive.

In this method, the substrate may include another hole disposed at a position corresponding to a position where the dome-forming material will adhere to an outer surface of the substrate, and disposed in the another hole in the substrate may be a peg which assists in securing the dome-forming material to the substrate.

In this method, the peg may be metal.

In this method, the peg may be made of fiberglass.

In this method, the rigid mat template may be made of hard rubber, wood, plastic, foam, or metal.

A method of forming a molded dome of a detectable warning area may comprise: mixing a dome-forming material with a catalyst to form a mixture; sealing one end of a dome-shaped cavity of a rigid mat template; pouring the mixture into the other end of the dome-shaped cavity of the rigid mat template; allowing the mixture in the dome-shaped cavity of the rigid mat template to catalyze and harden, removing from the dome-shaped cavity of the rigid mat template, a molded dome; and securing the molded dome to substrate.

In this method, the molded dome may have a top surface diameter of 0.9 inches to 1.4 inches, inclusive, a bottom surface diameter of 50-65% of the top opening diameter, inclusive, and a height of 0.18 inches to 0.22 inches, inclusive.

This method may further comprises, placing a grommet into the other end of the dome-shaped cavity of the rigid mat template before the mixture is poured in.

This method may further or alternatively comprise inserting a peg into the mixture poured into the other end of the dome-shaped cavity of the rigid mat template.

In this method, the peg may be made of metal.

In this method, the peg may be made of fiberglass.

In this method, the rigid mat template may be made of hard rubber, wood, plastic, foam, or metal.

A method of forming a dome of a detectable warning area may comprise: mixing a dome-forming material with a catalyst to form a mixture; sealing one end of a dome-shaped cavity of a rigid mat template; pouring the mixture into the other end of the dome-shaped cavity of the rigid mat template; allowing the mixture in the dome-shaped cavity of the rigid mat template to catalyze and harden, removing from the dome-shaped cavity of the rigid mat template, a molded dome; and securing the molded dome to a substrate at a location where the detectable warning area is to be formed.

In this method, the molded dome may have a top surface diameter of 0.9 inches to 1.4 inches, inclusive, a bottom surface diameter of 50-65% of the top opening diameter, inclusive, and a height of 0.18 inches to 0.22 inches, inclusive.

The method may further comprise: placing a grommet into the other end of the dome-shaped cavity of the rigid mat template before the mixture is poured in; and removing the grommet from the molded dome and the rigid mat template.

The method may further comprise: inserting a peg into the mixture poured into the other end of the dome-shaped cavity of the rigid mat template; drilling a hole in the substrate at a location where the molded dome is to be secured thereto, wherein the peg assists in securing the molded dome to the substrate.

In this method, the peg may be made of metal.

In this method, the peg may be made of fiberglass.

In this method, the rigid mat template may be made of hard rubber, wood, plastic, foam, or metal.

Of course, while these methods and apparatuses have been described individually, this by no means indicates that features thereof cannot be combined. Indeed, the only reasons such features are not discussed above as being combinable is for brevity.

DETAILED DESCRIPTION OF THE INVENTION

When the terms "on" or "over" are used herein, when referring to layers, regions, patterns, or structures, it is understood that the layer, region, pattern or structure can be directly on another layer or structure, or intervening layers, regions, patterns, or structures may also be present. When the terms "under" or "below" are used herein, when referring to layers, regions, patterns, or structures, it is understood that the layer, region, pattern or structure can be directly under the other layer or structure, or intervening layers, regions, patterns, or structures may also be present. When the term "directly on" is used herein, when referring to layers, regions, patterns, or structures, it is understood that the layer, region, pattern or structure is directly on another layer or structure, such that no intervening layers, regions, patterns, or structures are present. When the term "direct contact" is used herein, when referring to layers, regions, patterns, or structures in contact with other layers, regions, patterns, or structures, it is understood that the layer, region, pattern or structure is in direct, physical contact with the other layer, region, pattern, or structure, such that no intervening layers, regions, patterns, or structures are present.

When the term "about" is used herein, in conjunction with a numerical value, it is understood that the value can be in a range of, for example, 95% of the value to 105% of the value, i.e. the value can be, for example, +/−5% of the stated value. For example, "about 1 kg" means from 0.95 kg to 1.05 kg.

Embodiments of the disclosure relate to detectable warning areas (DWAs), methods of forming DWAs, kits for forming DWAs, components of DWAs, methods of forming components of DWAs, and apparatuses to form DWAs. A DWA can include one or more domes. e.g., truncated domes. That is, any or all of the domes of the DWA can be a truncated dome. As used herein, the term "truncated dome" means that the base of the dome attached (or not attached) to the substrate is wider than the top portion of the dome. Generally, the domes will be truncated and therefore will have a frustoconical shape. The truncated domes however can also have a slightly curved outer edge (not illustrated), though embodiments are not limited thereto. The domes can be of the type described in U.S. '216.

Some embodiments of the disclosure allow for preparing a dome or domes of a DWA by casting a die-cast mold to prefabricate domes (e.g. truncated domes) in a factory so as to meet Americans with Disabilities Act (ADA) specifications (guidelines) or other relevant specifications or guidelines.

A method of forming a DWA can include preparing at least one dome 1, the at least one dome 1 comprising a peg 3 preparing a substrate 20, and inserting the at least one dome 1 into the substrate 20.

Figure 2:
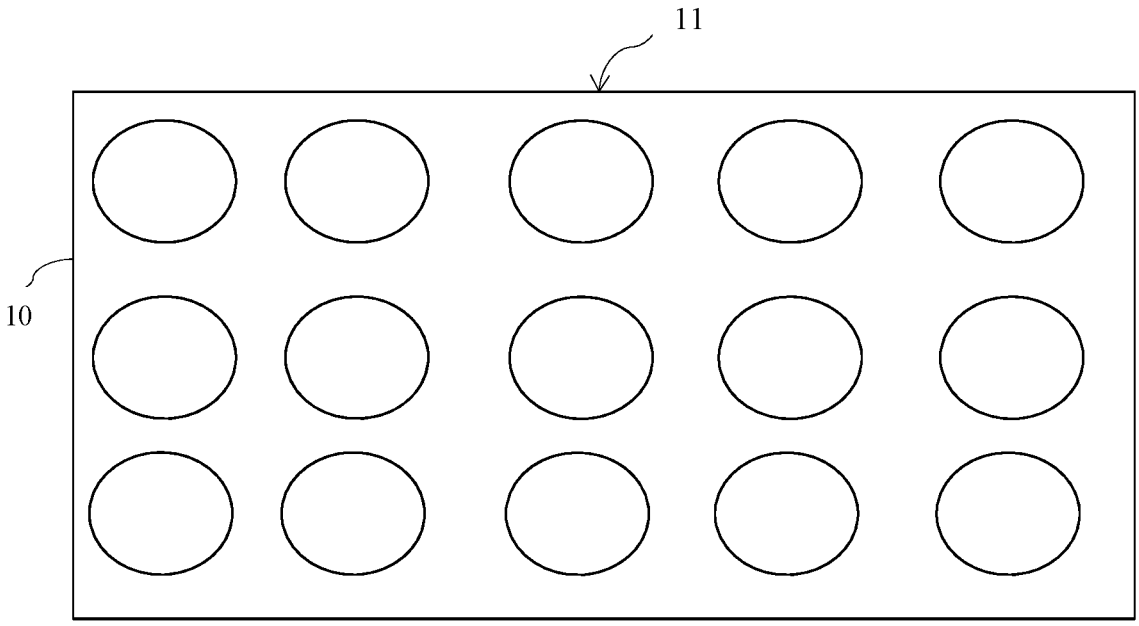
FIG. 2 shows a top view image of a die-cast mold according to one or more embodiments.

The at least one dome 1 may be prepared by using a die-cast mold 10. As illustrated in FIG. 2, the die-cast mold 10 may comprise a plurality of holes 11. Alternatively the die-cast mold may contain only a single hole.

Figure 4:
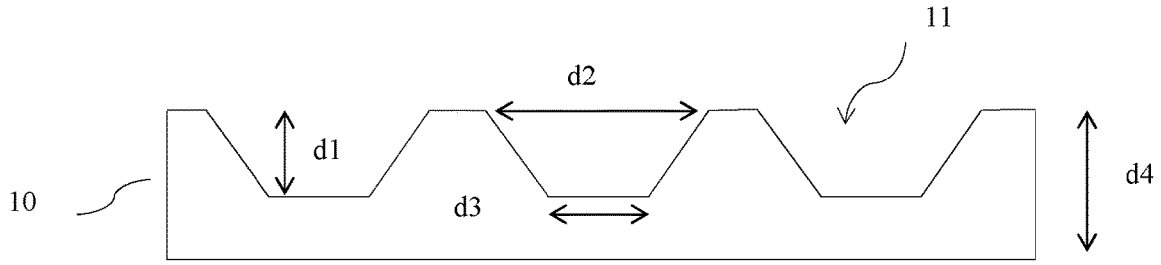
FIG. 4 shows a side view image of a die-cast mold according to one or more embodiments.
Figure 5:
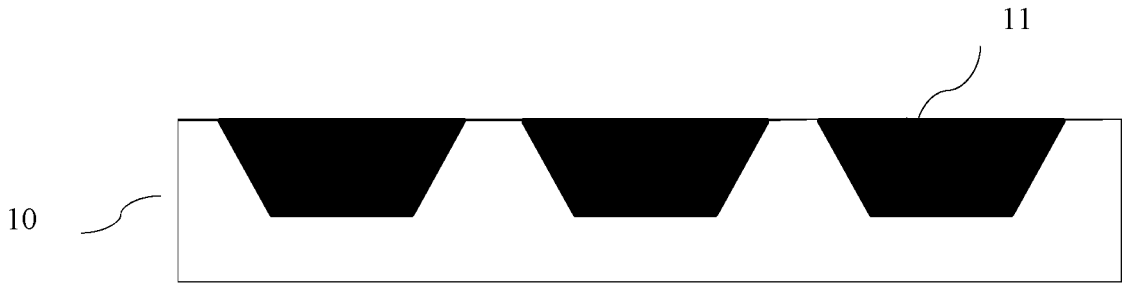
FIG. 5 shows a side view image of a die-cast mold filled with dome-forming material according to one or more embodiments.

Referring to FIG. 4, each hole 11 of the die-cast mold 10 may have a height d1 in the range of about 0.18 inches to about 0.22 inches, inclusive, with a preferable height of 0.20 inches. Each hole 11 may have an upper portion, corresponding to a lower portion of a dome when the dome is standing upright, with a diameter d2. Each hole 11 may also have a lower portion, corresponding to an upper portion of the dome when the dome is standing upright, with a diameter of d3. The diameter d2 is in the range of about 0.90 inches to 1.40 inches, inclusive, and the diameter d3 is about 50 to 65 percent of the diameter d2, inclusive.

The dimensions of the hole 11 correspond to the final dimensions of the formed dome, as specified by the ADAAG.

Different holes 11 of the die-cast mold 10 may have different measurements. That is, while it is preferable that all holes 11 have the same dimensions, not all holes 11 must have the same dimensions. In other words, the dimensions of the holes 11 need not be uniform. so long as their dimensions fall within the range described above.

Figure 3:
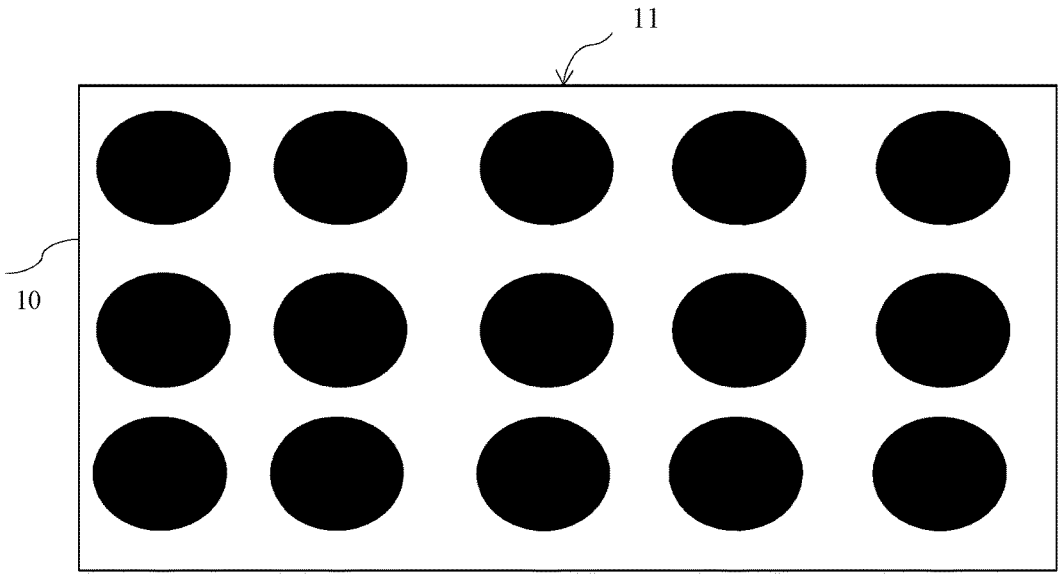
FIG. 3 shows a top view image of a die-cast mold filled with dome-forming material according to one or more embodiments.

When preparing the at least one dome 1 using the die-cast mold 10, dome-forming material can be inserted into the holes 11. This is illustrated in FIG. 3, wherein the holes 11 have dome-forming material inserted therein. The dome-forming material can be inserted into the holes 10 by pouring the dome-forming material into the holes 11, injecting the dome-forming material into the holes 11, or by using a tool, such as a squeegee. The squeegee can include a handle and a flat portion. The flat portion can be, for example, a pliable material such as rubber or plastic, though embodiments are not limited thereto. Of course other methods of inserting the dome-forming material can be used. That is, embodiments are not limited to the above-described methods of inserting the dome-forming material into the holes 11. Preferably, though not necessary in all cases, the dome-forming material should be filled to the top of the hole 11 of the die-cast mold 10.

The dome-forming material may include a catalyst, a reagent, and a filler. However, in some embodiments, at least one of the catalyst, reagent, and filler may be omitted. The catalyst, reagent, and filler may be mixed before being inserted into the holes 11. Examples of catalysts that may be used may include, but are in no way limited to: acrylic catalysts. Examples of reagents that may be used may include, but are in no way limited to epoxy reagents. Examples of a filler that may be used may include, but are in no way limited to crushed glass. The dome-forming material may comprise materials discussed in U.S. '216.

Figure 6:
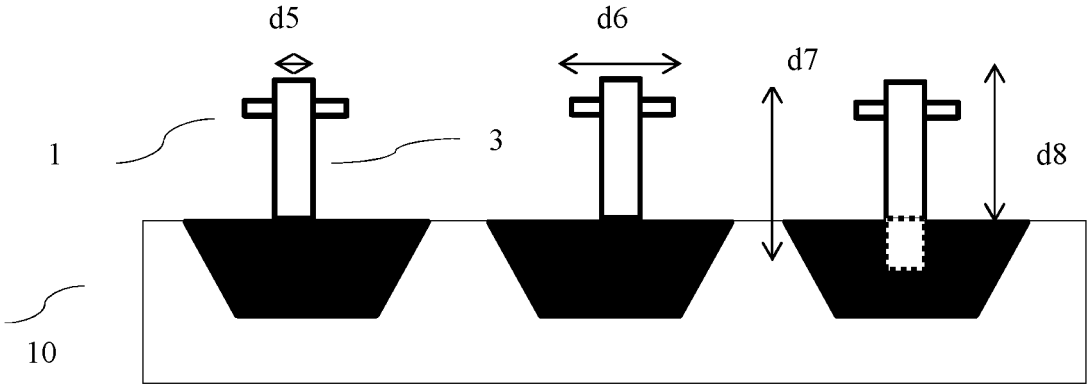
FIG. 6 shows a side view image of a die-cast mold filled with dome-forming material and having a peg inserted therein according to one or more embodiments.

After the dome-forming material is inserted into the holes 11, a peg 3 may inserted into the already-inserted dome-forming material within the holes 11, as illustrated in FIG. 6. However, a peg 3 need not be inserted in all embodiments. Also, the peg 3 may be placed into the hole 11 before the dome-forming material is inserted therein. The peg 3 may comprise stainless steel or any other suitable material, although stainless steel is preferable. The peg 3 may have a total length d7 of about 2.0 inches. When inserting the peg 3 into the dome-forming material which is already inserted into the holes 11, the peg 3 may be inserted to a depth of about 0.5 to 1 inches, such that the peg 3 extends from the top surface of the dome-forming material (corresponding to the bottom portion of the dome when the dome is standing upright) by about 1.5-1 inches. FIG. 6 illustrates on the right side of the drawing, a cut-away view of a hole 11 having dome-forming material therein so that the portion of the peg 3 inserted may be viewed.

The peg 3 may have an outer diameter d5 of about 0.25-0.30 inches.

Figure 1:
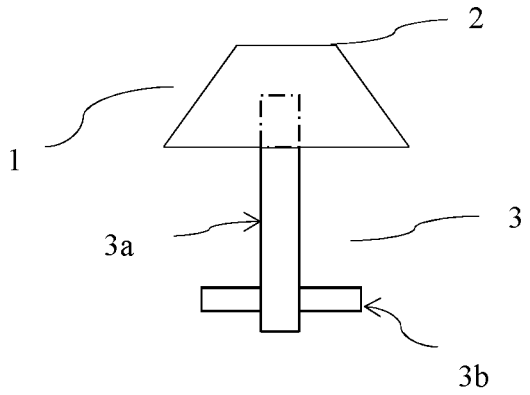
FIG. 1 shows a side view image of a dome of a DWA according to one or more embodiments.
Figure 11:
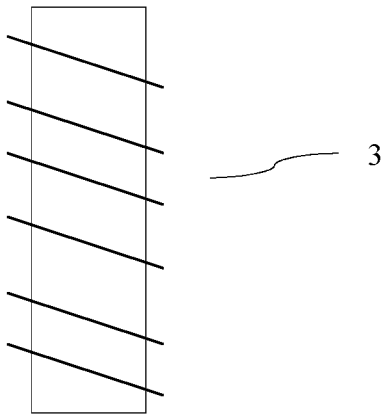
FIG. 11 shows a side view of a peg according to one or more embodiments.
Figure 12:
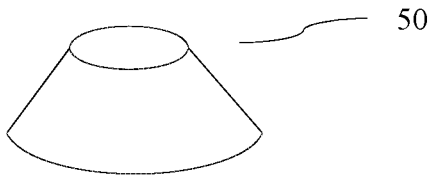
FIG. 12 shows a front elevation view image of an insert according to one or more embodiments.
Figure 13:
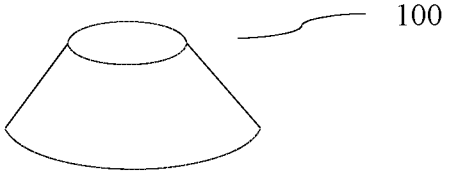
FIG. 13 shows a side elevation view image of a dome of a DWA according to one or more embodiments.
Figure 14A:
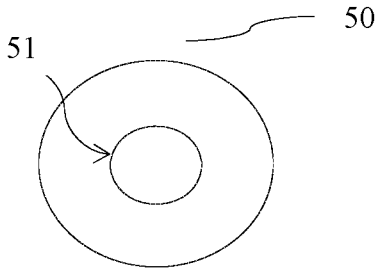
FIG. 14A shows a top view image of an insert according to one or more embodiments.
Figure 14B:
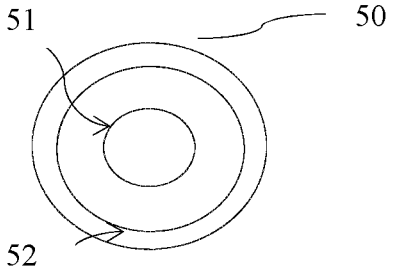
FIG. 14B shows a bottom view image of an insert according to one or more embodiments.
Figure 15:
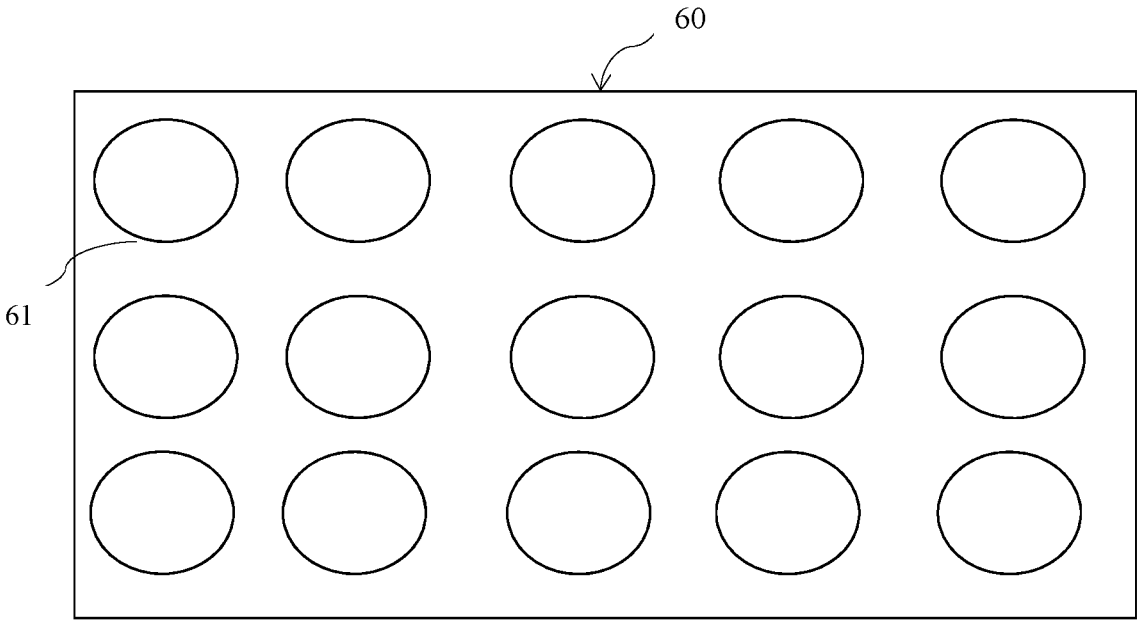
FIG. 15 shows a top view image of a mat template according to one or more embodiments.
Figure 16:
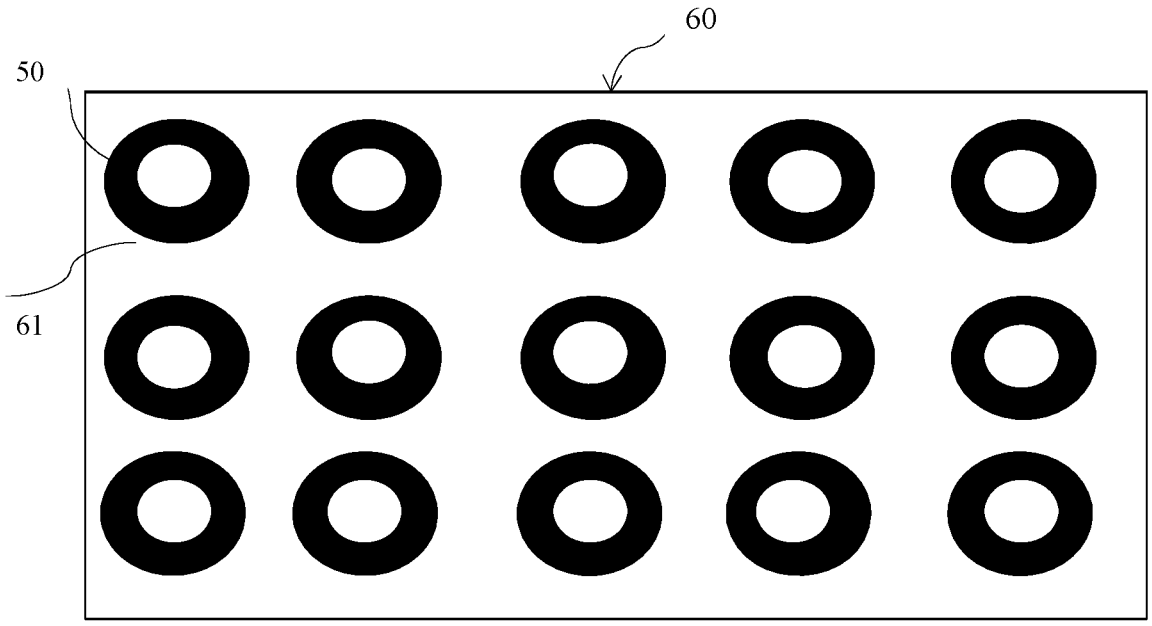
FIG. 16 shows a top view image of a mat template having inserts placed therein according to one or more embodiments.

The peg 3 may include two wings 3*b* which protrude from a peg shaft 3*a*, as illustrated in FIG. 1. These wings 3*b* and peg together may have a total combined width d6 of about 0.30-0.33 of an inch, as illustrated in FIG. 6. The peg 3 may also or alternatively have other protrusions such as a disk-shaped protrusion or a helical screw protrusion, as illustrated in FIG. 11.

After the peg 3 is inserted into the dome-forming material already inserted into the holes 11, the dome-forming material may be allowed to catalyze and/or cure for about 20 minutes. Of course, depending on the materials used for the dome-forming material, different catalyzing/curing times may be employed. For example, the catalyzing/curing times discussed in U.S. '216 may be employed.

After catalyzing/curing, the at least one dome 1 will harden. After hardening, the at least one dome 1 may be removed from the mold 10. In some embodiments however, the at least one dome 1 may be removed before completely hardening.

In order to form the DWA, the at least one dome 1 should be inserted into a prepared substrate. Methods of preparing a substrate 20 will now be described.

The substrate 20 may comprise different materials. For example, concrete, asphalt, brick, stone, a raised or previously-stamped surface, or a Chattahoochee surface, though embodiments are not limited thereto. Indeed, in some embodiments, the substrate 20 may comprise a mixture of these materials or other materials, or a mixture of both.

To prepare the substrate 20, the substrate 20 should first be cleaned so as to remove dirt, debris, and other loose particles. However, sometimes it may be unnecessary to clean the substrate 20.

After the substrate 20 is cleaned (if necessary), a hole 21 should be made in the substrate 20. While the hole 21 can be formed in many different ways, in preferable embodiments, the hole 21 is formed by a drill, for example, a hand-held drill. The hole 21 should have a depth d14 of about 1.5-2.0 inches, and a diameter d14 of about $5/16^{th}$ of an inch.

After the hole 21 is prepared in the substrate 20, the substrate 20 should again be cleaned so as to remove dirt, debris, and other loose particles. However, sometimes it may be unnecessary to clean the substrate 20 again or if at all.

After again cleaning the hole 21 and the substrate 20 (if necessary), the hole 21 and the area of the substrate above and surrounding the hole 21 (preferably an area corresponding in size the outer diameter of the at least one dome 1) may be coated with a bonding agent, for example, an asphalt sealer such that the at least one dome 1 may be sufficiently secured to the substrate 20. Preferably the bottom of the at least one dome 1 and the peg 3 of the at least one dome 1 may also be coated with a bonding agent, for example the same bonding agent applied to the hole 21 and the substrate 20. The bonding agent is preferably the same color as the dome, and in some embodiments may be even be the same dome-forming material.

After all appropriate surfaces are coated with the bonding agent, the at least one dome 1 may be placed on the substrate such that the at least one peg 3 is inserted into the hole 21 of the substrate.

After the at least dome 1 is placed, e.g., installed on the substrate 20, a top portion 2 of the at least one dome 1 should protrude from the at least one substrate by a height d14 of in the range of 0.19 to 0.22 inches, inclusive, and preferably by 0.20 inches.

This forms a DWA. Of course in this case, the sealing agent should be given sufficient time to dry before the DWA is ready for use. For example, after the at least one dome 1 is placed on the substrate 20, the sealing agent may be allowed to cure for 15-20 minutes before the DWA formed by the at least one dome 1 and the substrate 20 are ready for use. Of course different curing times may be employed depending on the environment and materials used.

When forming a DWA comprising of more than one dome, the domes should preferably be places such that they have a center-to-center spacing in the range of 1.6 inches (41 mm) to 2.4 inches (61 mm), and a base-to-base spacing of preferably 0.65 inches (17 mm).

In addition, when the DWA is plated at a platform boarding, edges thereof should preferably be 24 inches wide and extend the full length of the public use areas of the platform.

Further, the DWA should contrast visually with adjacent walking surfaces either light on dark or dark on light.

Optionally, after the at least one dome 1 is placed on the substrate 20 and the peg 3 is inserted into the hole 21, the outer top surface of the dome 1 may be subjected to a finishing/grinding treatment.

This finishing/grinding treatment, described below, may also be applied to a dome or domes of a DWS (or a dome or dome not part of a DWA) that have not been formed by the above-described or below-described processes and methods.

Figure 7:
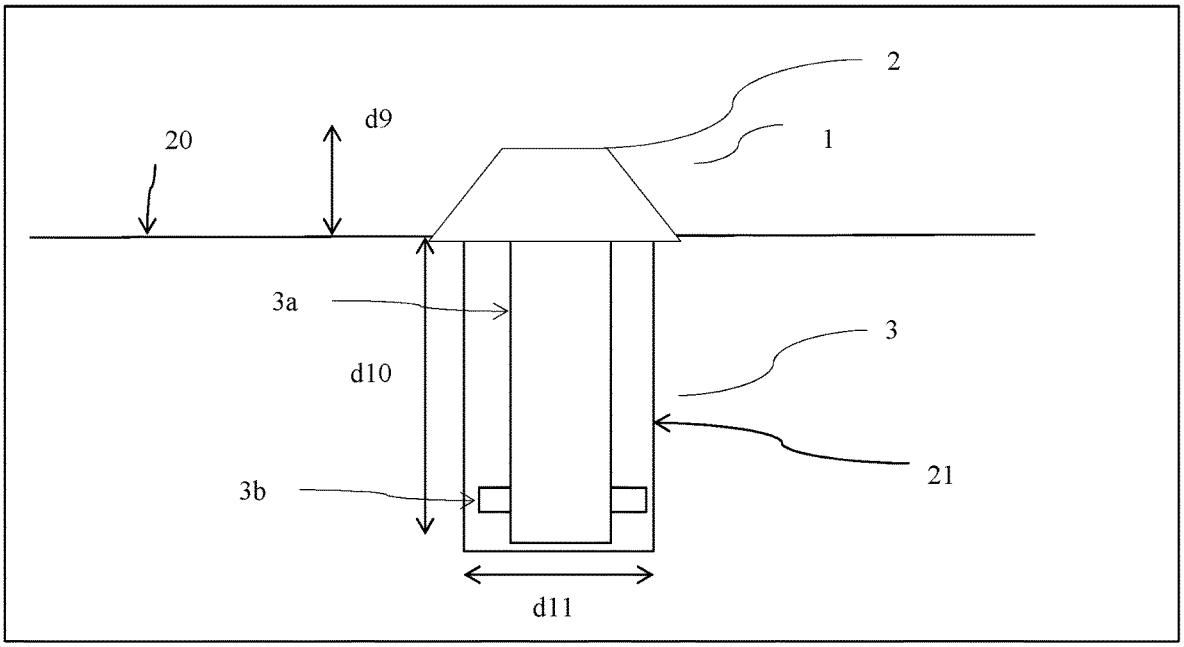
FIG. 7 shows a side view image of a DWA according to one or more embodiments.
Figure 8:
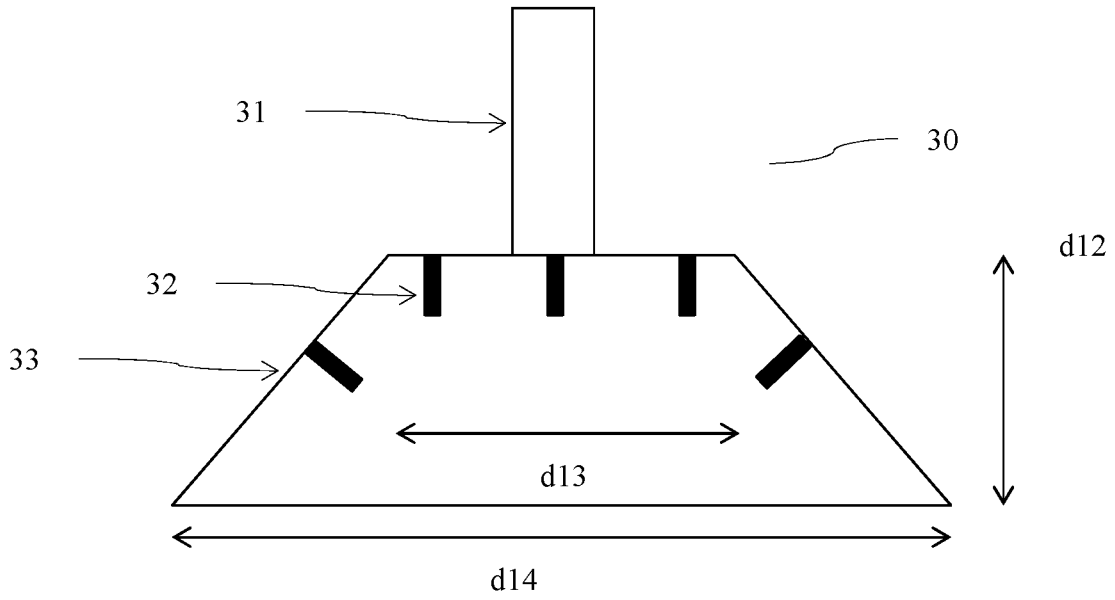
FIG. 8 shows a side view image of a drilling attachment according to one or more embodiments.

The finishing treatment may involve grinding the top surface of the at least one dome 1 by a drilling tool, such as a drilling attachment 30 depicted in FIG. 7.

The drilling attachment 30 may be of a truncated shape with a bottom thereof having a larger diameter than a top thereof. Specifically for example, the drilling attachment 30 may have a drilling portion 33, which may have a top diameter d13 of about 0.57 inches, and a bottom diameter d14 of about 1.0-1.14 inches. The drilling portion 33 may have a height d12 of about 0.20 inches.

The drilling attachment 30 may also include blades 32 for grinding the top surface of a dome. The blades 32 may be formed of, for example, stainless steel, ceramic #3, or heat treated steel, though other suitable materials may also be used. The inner sizing of the drill portion 33, the length and position of the blades may be such to form an outer surface of a dome to have a height in the range of 0.18 inches to 0.22 inches, a base diameter in the range of 0.9 inches to 1.4 inches, and a upper portion diameter having a diameter within a range of 50 to 65 percent of the base diameter.

The drilling attachment 30 may be inserted on a tool, for example a drill, more specifically for example, a hand-held drill. Specifically the shaft portion 31 of the drilling attachment 30 may inserted onto a corresponding shaft of the tool.

Figure 9A:
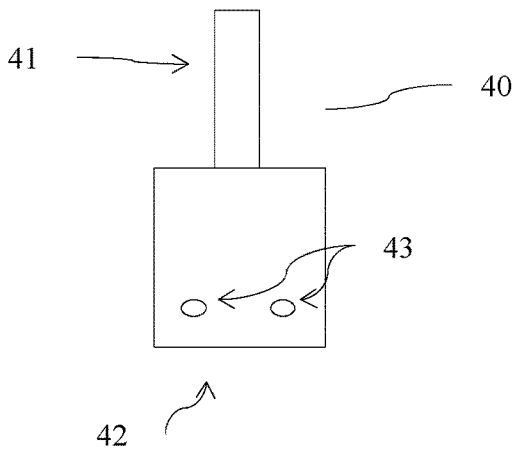
FIG. 9A shows a side view of a portion of a drilling attachment according to one or more embodiments.
Figure 9B:
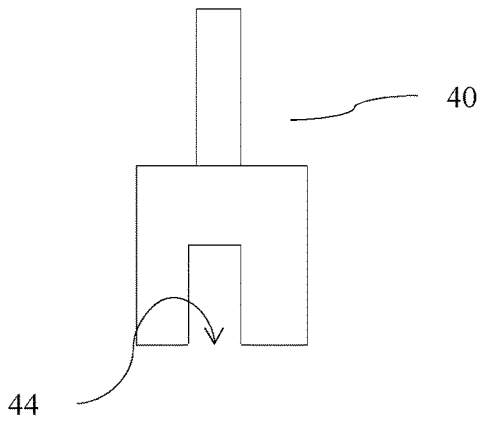
FIG. 9B shows a side view of a portion of a drilling attachment according to one or more embodiments.
Figure 10:
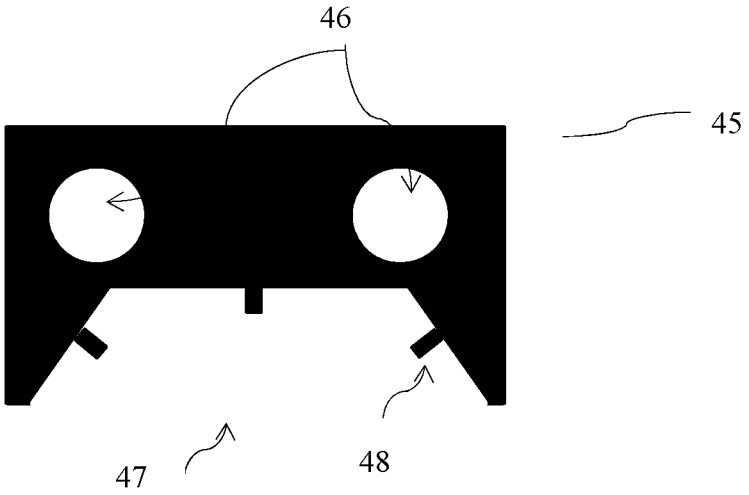
FIG. 10 shows a side view of a portion of a drilling attachment according to one or more embodiments.

According to another embodiment of the drilling tool, the drilling tool may comprise a two-piece design as depicted in FIGS. 9A, 9B, and 10. For example, the drilling tool according to this embodiment may comprise a clamp attachment 40. The claim attachment 40 may have a shaft portion 41 for being inserted into a drill, and a base portion 42 having an insertion slot 44, into which a drilling portion 45 may be inserted, attached and secured via screw holes 43 and 46. A screw or other attachment means may be inserted through the screw holes 43 and 46.

The drilling portion 45 may also comprise blades 47 and 48. The inner sizing of the drilling portion 45, the length and position of the blades 47 and 48 may be such to form an outer surface of a dome to have a height in the range of 0.18 inches to 0.22 inches, a base diameter in the range of 0.9 inches to 1.4 inches, and a upper portion diameter having a diameter within a range of 50 to 65 percent of the base diameter.

Also, while it has been described that the at least dome 1 may be subjected to the finishing treatment after being installed on the substrate 20, the finishing treatment may also be performed before installation.

Another method of forming a DWA is described below. In this method, those elements and features common to the method described above may be referred to and used interchangeably.

This method can include preparing a substrate 20 (cleaning preferred but optional) for forming at least one dome thereon. This method comprising using a mat template 60, such as that described in, for example, U.S. '216. However, different mat templates, for example, those having more or less openings than those 61 shown in mat template 60, can also be used.

This method further comprising inserting into the mat template 60 an insert 50. The insert 50 preferably has a geometric shape corresponding to the shape of a dome 100 of the DWA. For example, the inner area of the insert 50 may have a matching shape of the outer surface of the dome 100. The insert 50 preferably has a bottom hole or opening 52 and a top hole or opening 51.

Here, the dome 100 may have dimensions corresponding to the dome 1, and may or may not include a peg.

While it is preferably that an insert 50 is placed into each opening 61 of the mat template 60, some openings 61 may not having inserts placed therein.

After the insert 50 is placed into the openings 61 of the mat template 60, the mat template 60 may be placed onto a substrate 20 on which the DWA is to be formed.

Next, dome forming material, for example, the dome forming material discussed above, may be poured and/or worked into (e.g., manually) the top hole or opening 51 of the insert 50 inside of the mat template 60.

Next, the dome forming material is allowed to cure and harden.

After the dome forming material has cured and hardened (preferably completely, but varying curing and hardening times may be used) the mat template 60 and the insert 50 may be removed from the substrate 20. Further, the insert 50 may be removed from the substrate 20 through the use of a tool, for example, a putty knife, by applying pressure to the underside of the insert 50.

After the insert 50 and the mat template 60 are removed, at least one dome 100 is left as formed.

Another method of forming a DWA is described below. In this method, those elements and features common to the methods described above may be referred to and used interchangeably.

Figure 17:
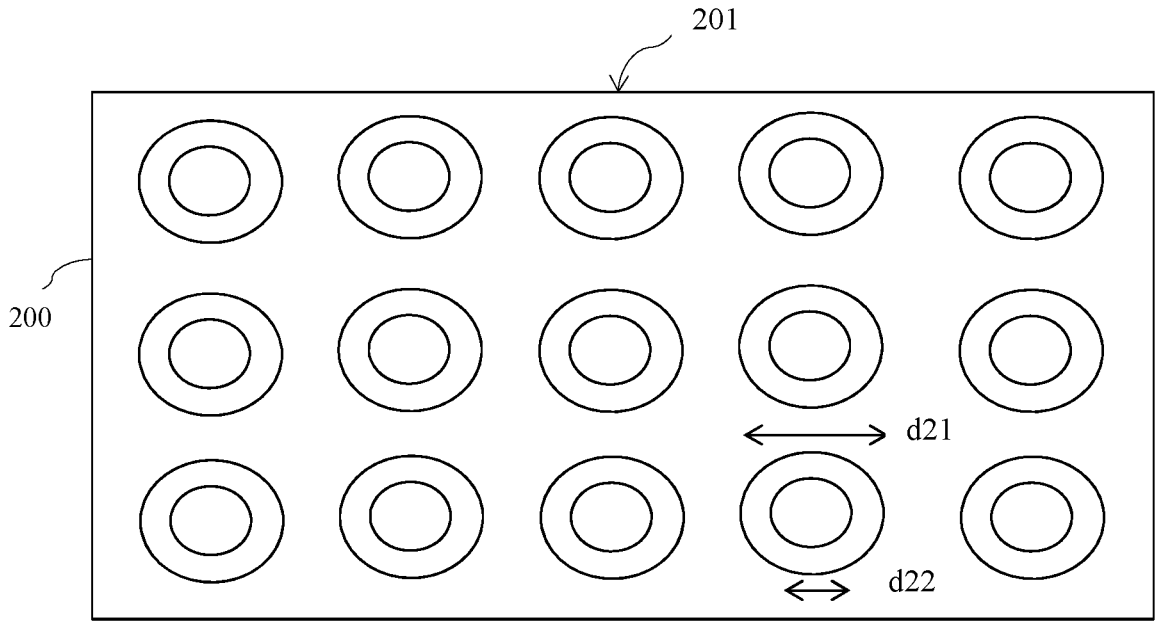
FIG. 17 shows a top view image of a mat template according to one or more embodiments.
Figure 19:
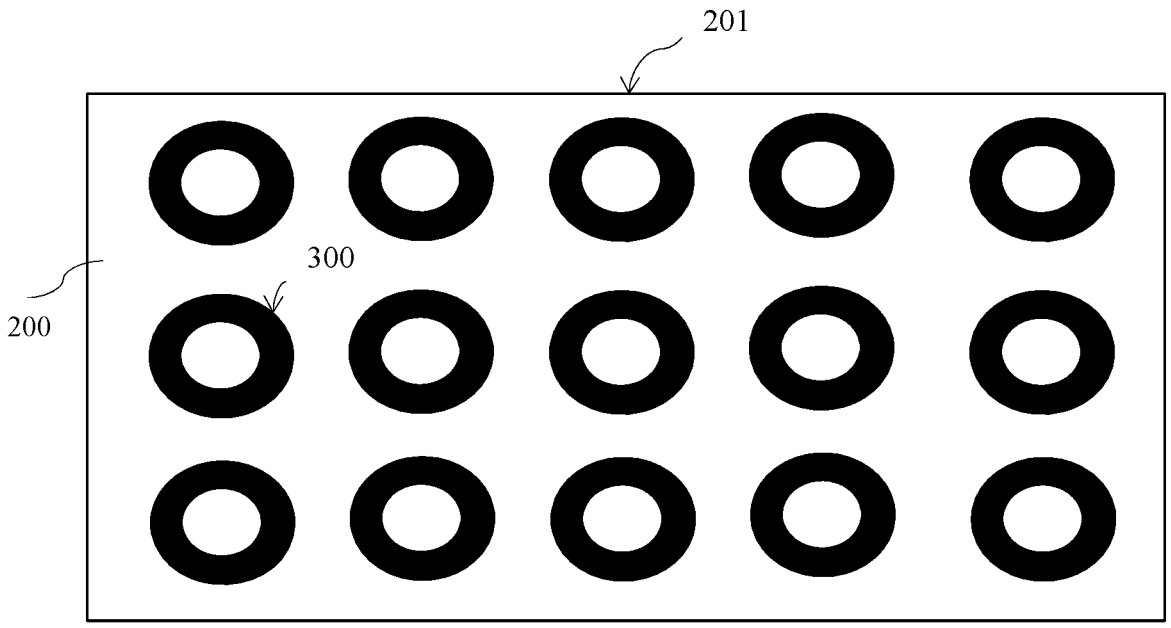
FIG. 19 shows a top view image of a mat template having grommets placed therein according to one or more embodiments.

In this method, the dome or domes of a DWA may be made with a reusable mat template 200 having openings 201, as shown in FIGS. 17 and 19. The reusable mat template 200 may be formed of hard rubber, wood, plastic, foam, or metal, or any other suitable material. In general the reusable mat template 200 is rigid, though it may also be flexible. The reusable mat template may have one opening 201 or multiple openings 201. Preferably, when there are multiple openings 201, the openings 201 are spaced according to ADAAG.

The openings 201 may have a bottom opening diameter d21 of about 0.9 to 1.4 inches and a top opening diameter d22 of 0.18 to 0/22 inches. The openings 201 may extend the entire distance through the reusable mat template 200. That is, the openings 201 may be holes.

Figure 18:
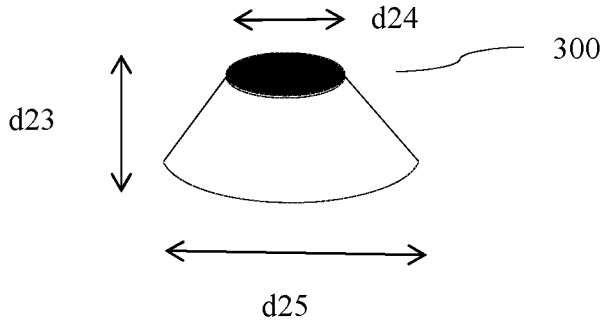
FIG. 18 shows a grommet according to one or more embodiments.

In this method, grommets 300, shown in FIG. 18, may be inserted into the openings 201 of the reusable mat template 200 from the bottom of the reusable mat template 200. The grommets 200 may be formed of a polyurethane-type material. Like the mat template 200, the grommets 300 may also be reusable. The grommets may be of the same general shape as the domes 1, preferably frustoconical. However, the grommets 300 are hollow and have a top opening extending to a bottom opening. The grommets 300 may have a bottom opening diameter d25 in the range of 0.9 to 1.4 inches, inclusive, for example, 1.20 inches. The grommets 300 may have a top opening diameter d24 of about 50-65% of the bottom opening diameter, for example, 0.59 inches. The grommets 300 may also have a thickness of about 0.37 inches, a height d23 in the range of 0.18 to 0.22 inches, inclusive, for example, 0.22 inches.

After the grommets 300 are inserted into the reusable mat 200, as shown in FIG. 19, the previously described dome-forming material may be inserted, by, for example, the methods discussed above, into the hole/cavity of the grommets 300.

Thereafter, the dome-forming material may be allowed to catalyze and harden for the time discussed above. After the dome-forming material has sufficiently hardened/catalyzed, the reusable mat template 200 and the grommets 300 may be removed, leaving at least one dome 100 formed.

Figure 20:
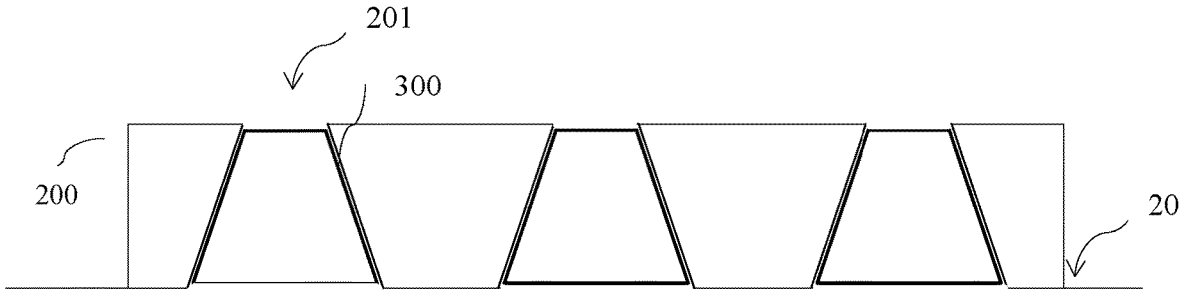
FIG. 20 shows a side view of a mat template having grommets placed therein, on top of a substrate according to one or more embodiments.
Figure 21:
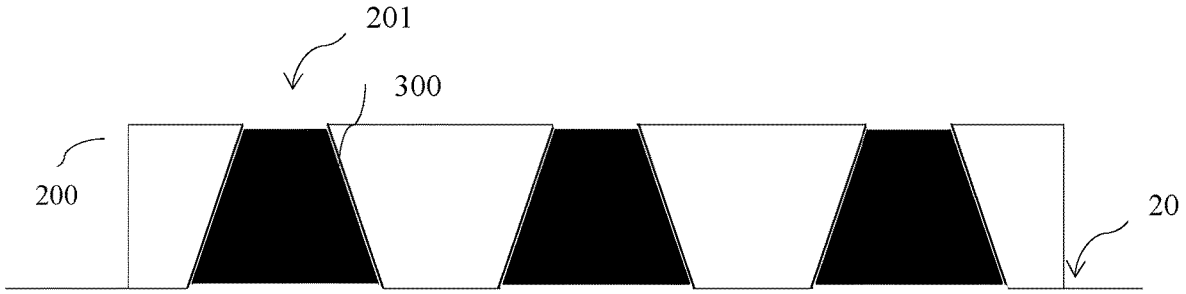
FIG. 21 shows a side view of a mat template having grommets placed therein and having a dome-forming material inserted therein, on top of a substrate according to one or more embodiments.

Preferably, in this method, the domes 100 are formed on top of the substrate 20. Specifically for example, as shown in FIGS. 20-21, after the grommets 300 are inserted into the reusable mat template 200, the reusable mat template may be secured to the substrate 20, by, for example, screws, weights, or the like, or by drilling a 3/16 inch diameter hole into the substrate 20 (approximate depth of the drilling hole could be about 1.25 inches) and inserting a 3/16×1 inch concrete screw into the drilled hole to tightly fix the mat template 200 to the substrate. The mat template 200 may be fastened at each corner and mid areas of the mat template 200. After the reusable mat template is secured to the substrate 20, the dome-forming material may be inserted into the hole/cavity of the grommets 300.

After the dome-forming material has sufficiently hardened/catalyzed, excess dome-forming material may be removed, for example, by scraping, from the top surface of the reusable mat template 200. Thereafter, the reusable mat template 200 and the grommets 300 may be removed, leaving at least one dome 100 formed.

In one embodiment, the substrate 20 may have a hole corresponding to a location of where the dome 100 is to be formed, and there may be a peg 3 inserted in the dome-forming material to bind the dome 100 to the substrate with the corresponding hole. The peg maybe made of metal or fiberglass, and may be generally of the type described above.

Another method of forming a DWA is described below. In this method, those elements and features common to the methods described above may be referred to and used interchangeably.

In this method, the dome or domes of a DWA may be formed as follows:

Here, the reusable mat template 200 may be used, but the reusable mat template may have different dimensions, specifically, the openings 201 may have a geometrical shape more closely corresponding to the geometrical shape of the dome 100 of the detectable warning area, that is, the grommets 300 may not be necessary. However, the grommets 300 may be used in some embodiments.

In this method, the top openings of the openings 201 of the reusable mat template 200 may be sealed, and dome-forming material may be inserted into the openings 201 from the bottom openings, while the reusable mat template is resting on a surface in an upside-down configuration.

Optionally a peg 3 like those discussed above, may be inserted into the dome-forming material before the dome-forming material is allowed to catalyze and harden. Here, the peg may have a length d8 of about 2 inches in total length.

After the dome-forming material has sufficiently hardened/catalyzed, the subsequently formed domes 100 may be removed from the reusable mat template.

Thereafter, the domes 100 may be placed and secured, via, for example a polymer resin anchoring material such as KELIGROUT™, to the substrate 20. Generally, curing time may be about 30 minutes.

If these domes 100 include pegs 3, the substrate 20 may include corresponding holes for the pegs 3 to assist in securing the domes 100 to the substrate 20.

It should be understood that the examples and embodiments described herein are for illustrative purposes only and that various modifications or changes in light thereof will be suggested to persons skilled in the art and are to be included within the spirit and purview of this application. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

It should also be understood that while the above disclosure has been described with reference to numerous methods, the disclosure is not limited as such and encompasses corresponding apparatuses formed by and in use by the described methods.

REFERENCE NUMERALS

1: dome (e.g., at least one 1 dome),
2: top portion of the dome 1,
3: peg of the dome 1,
3*a*: peg shaft,
3*b*: peg wings,
10: die-cast mold,
11: hole of die-cast mold 10,
20: substrate,
21: hole in substrate 20,
30: drilling attachment,
31: shaft of drilling attachment 30,
32: blades of drilling attachment 30,
33: drilling portion of drilling attachment 30,
40: clamp attachment,
41: shaft portion,
42: base portion,
43: screw holes,
44: insertion slot,
45: drilling portion,
46: screw holes,
47: blades,
48: blades
d1: height of hole 11 of die-cast mold 10,
d2: upper diameter of hole 11 of die-cast mold 10,
d3: bottom diameter of hole 11 of die-cast mold 10,
d4: height of die-cast mold 10,
d5: outer diameter of peg 3,
d6: combined width of peg wings 3*b* of peg 3,
d7: length of peg 3,
d8: length of peg 3 extending beyond bottom portion of dome 1,
d9: height of top portion 2 of dome 1,
d10: depth of hole 21,
d11: diameter of hole 21,
d12: height of drilling portion 33 of drilling attachment 30,
d13: top diameter of drilling portion 33 of drilling attachment 30,
d14: bottom diameter of drilling portion 33 of drilling attachment 30,
50: insert,
100: dome,
51: top hole or opening of insert,
52: bottom hole or opening of insert,
60: mat template,
61: opening of mat template,
200: reusable mat template,
201: reusable mat template openings,
d21: bottom opening diameter of reusable mat template openings,
d22: top opening diameter of reusable mat template openings,
300: grommet,
d23: height of grommet, d24: top opening diameter of grommet, d25: bottom opening diameter of grommet.

What is claimed is:

1. A method of forming molded domes of a detectable warning area, the method comprising:

mixing a dome-forming material with a catalyst to form a mixture;

providing a rigid mat template at a location different from where the detectable warning area is to be formed on a substrate, the rigid mat template having a plurality of dome-shaped cavities, each of the dome-shaped cavities having a first opening and a second opening, the second opening having a smaller diameter than the first opening;

after providing the rigid mat template, sealing the respective first openings of the plurality of the dome-shaped cavities of the rigid mat template;

after sealing the respective first openings, pouring the mixture into the respective second openings of the plurality of dome-shaped cavities of the rigid mat template;

after pouring the mixture, allowing the mixture in the plurality of dome-shaped cavities of the rigid mat template to catalyze and harden; and after allowing the mixture to catalyze and harden, removing from the plurality of dome-shaped cavities of the rigid mat template, a plurality of molded domes.

2. The method of forming molded domes of a detectable warning area according to claim 1, wherein the plurality of molded domes have respective top surface diameters of 0.9 inches to 1.4 inches, inclusive, respective bottom surface diameters of 50-65% of the respective top opening diameters, inclusive, and respective heights of 0.18 inches to 0.22 inches, inclusive.

3. The method of forming molded domes of a detectable warning area according to claim 1, the method further comprising:

after removing the plurality of molded domes, securing the plurality of molded domes to the substrate, thereby forming the detectable warning area thereon.

4. The method of forming molded domes of a detectable warning area according to claim 1, wherein the rigid mat template is made of hard rubber, wood, plastic, foam, or metal.

* * * * *